US006168269B1

(12) United States Patent
Rasmussen et al.

(10) Patent No.: US 6,168,269 B1
(45) Date of Patent: Jan. 2, 2001

(54) HEATED INKJET PRINT MEDIA SUPPORT SYSTEM

(75) Inventors: Steve O Rasmussen; Paul David Gast, both of Vancouver, WA (US)

(73) Assignee: Hewlett-Packard Co., Palo Alto, CA (US)

( * ) Notice: Under 35 U.S.C. 154(b), the term of this patent shall be extended for 0 days.

(21) Appl. No.: 08/913,561

(22) PCT Filed: Jan. 30, 1997

(86) PCT No.: PCT/US97/00957

§ 371 Date: Dec. 29, 1997

§ 102(e) Date: Dec. 29, 1997

(87) PCT Pub. No.: WO97/28003

PCT Pub. Date: Aug. 7, 1997

(51) Int. Cl.[7] ..... B41J 2/01
(52) U.S. Cl. ..... 347/102
(58) Field of Search ..... 347/101, 102, 347/104; 226/170–173; 271/198; 198/804, 818, 822, 844.1, 850; 34/611, 616, 617, 618, 619, 620, 621; 400/635, 636; 219/216, 656, 619, 653, 670

(56) References Cited

U.S. PATENT DOCUMENTS

| | | | | |
|---|---|---|---|---|
| 4,207,579 | | 6/1980 | Gamblin et al. | 346/75 |
| 4,803,500 | | 2/1989 | Milbrandt | 346/140 |
| 4,821,049 | | 4/1989 | Eckl | 346/134 |
| 4,872,027 | | 10/1989 | Buskirk et al. | 346/140 |
| 5,041,718 | * | 8/1991 | D'Hondt et al. | 219/216 |
| 5,094,613 | * | 3/1992 | Dolcimascolo et al. | 219/216 |
| 5,241,159 | * | 8/1993 | Chatteriee et al. | 219/216 |
| 5,342,133 | | 8/1994 | Canfield | 400/635 |
| 5,345,863 | | 9/1994 | Kurata et al. | 101/126 |
| 5,419,644 | | 5/1995 | Martin et al. | 400/642 |
| 5,428,383 | | 6/1995 | Shields et al. | 347/96 |
| 5,461,482 | | 10/1995 | Wilson et al. | 347/50 |
| 5,570,118 | * | 10/1996 | Rezanka et al. | 347/102 |
| 5,593,240 | | 1/1997 | Broder et al. | 400/352 |
| 5,668,584 | | 9/1997 | Broder et al. | 347/102 |
| 5,712,672 | * | 1/1998 | Gooray et al. | 347/102 |
| 5,714,736 | * | 2/1998 | Yoneda et al. | 219/216 |
| 5,784,090 | * | 7/1998 | Selensky et al. | 347/102 |
| 5,896,154 | * | 4/1999 | Mitani et al. | 347/102 |

FOREIGN PATENT DOCUMENTS

| | | | |
|---|---|---|---|
| 60-48385 | 3/1985 | (JP) | B41J 11/02 |

* cited by examiner

*Primary Examiner*—John Barlow
*Assistant Examiner*—Juanita Stephens
(74) *Attorney, Agent, or Firm*—Flory L. Martin

(57) ABSTRACT

To maintain a uniform spacing between the print media, such as paper or fabric, and an inkjet printhead having a large print swath, for instance about 25 millimeters (one inch) wide, a new media support system is provided for inkjet printing mechanisms, such as printers or plotters. The support system employs an endless belt (62) driven from the belt interior surface by a roller drive system that uniformly supports the printhead media under the reciprocating printhead (54, 56). The belt may be lined with anti-cockle ribs or it may be foraminous, with a vacuum applied thereunder to pull the media onto the belt. An ink drying system is included for heating the belt and thus the media to avoid ink bleed. A method is also provided for supporting and transporting a large sheet of print media through a printzone of an inkjet printing mechanism having such a large swath inkjet head.

10 Claims, 9 Drawing Sheets

FIG. 12
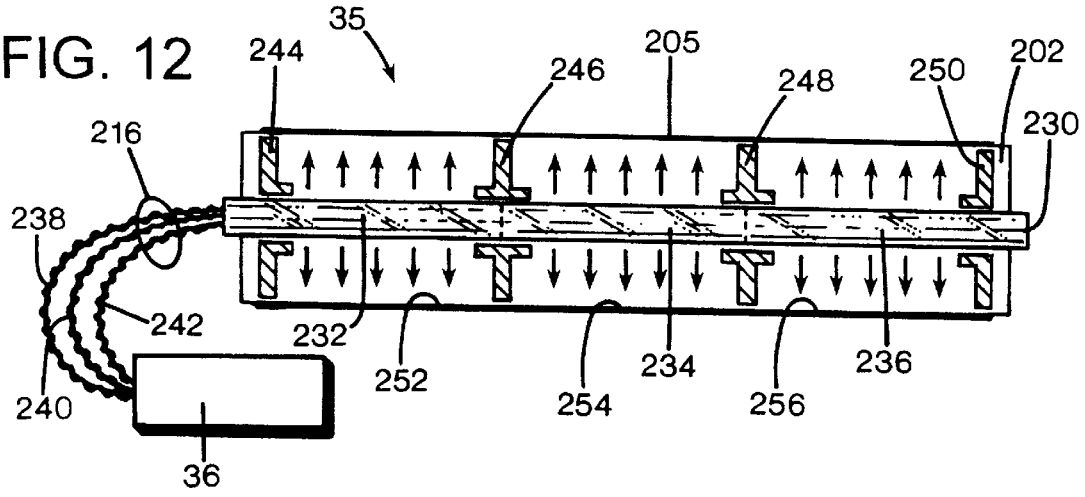
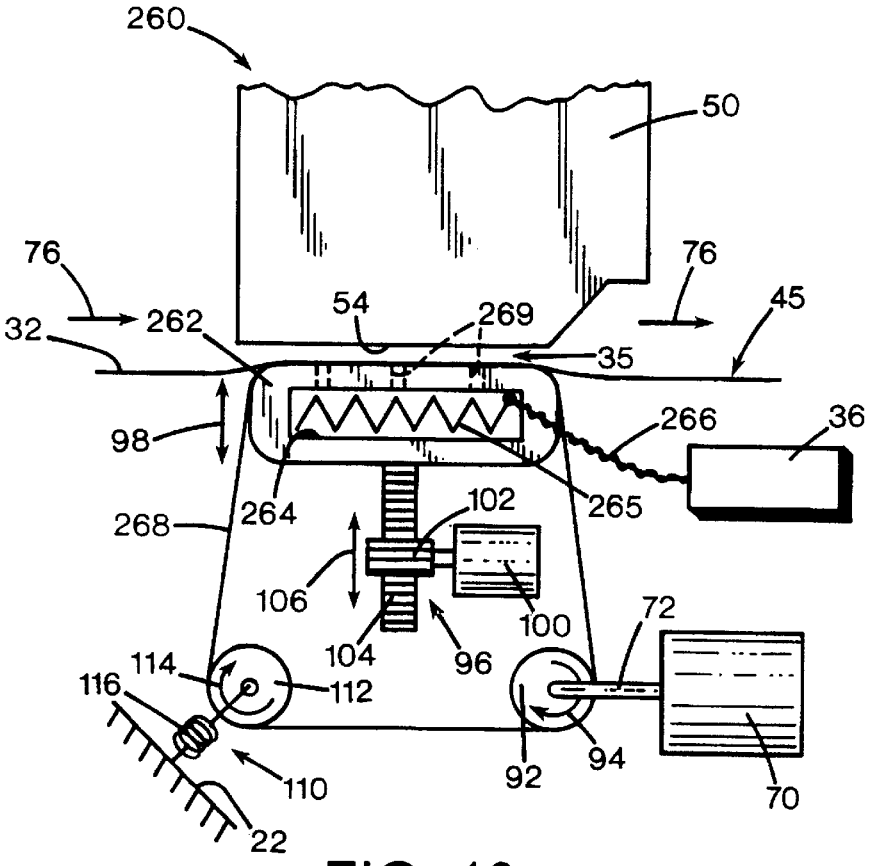
FIG. 13

HEATED INKJET PRINT MEDIA SUPPORT SYSTEM

FIELD OF THE INVENTION

The present invention relates generally to inkjet printing mechanisms, such as printers or plotters. More particularly the present invention relates to a media support system for maintaining a uniform spacing between the print media, such as paper or fabric, and an inkjet printhead having a large print swath, for instance about 20 millimeters to 25 millimeters (about one inch) wide or wider, as well as a system for warming the media support to speed drying of the ink.

BACKGROUND OF THE INVENTION

Inkjet printing mechanisms may be used in a variety of different products, such as plotters, facsimile machines and inkjet printers, to print images using a colorant, referred to generally herein as "ink." These inkjet printing mechanisms use inkjet cartridges, often called "pens," to shoot drops ink onto a page or sheet of print media. Some inkjet print mechanisms carry an ink cartridge with a full supply of ink back and forth across the sheet. Other inkjet print mechanisms, known as "off-axis" systems, propel only a small ink supply with the printhead carriage across the printzone, and store the main ink supply in a stationary reservoir, which is located "off-axis" from the path of printhead travel. Typically, a flexible conduit is used to convey the ink from the off-axis main reservoir to the printhead cartridge. In multi-color cartridges, several printheads and reservoirs are combined into a single unit, with each reservoir/printhead combination for a given color also being referred to herein as a "pen."

Each pen has a printhead formed with very small nozzles through which the ink drops are fired. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor.

To clean and protect the printhead, typically a "service station" mechanism is mounted within the plotter chassis so the printhead can be moved to the station for maintenance. For storage, or during non-printing periods, the service stations usually include a capping system which hermetically seals the printhead nozzles from contaminants and drying. Some caps are also designed to facilitate priming, such as by being connected to a pumping unit or other mechanism that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the face of the printhead.

To print an image, the printhead is scanned back and forth across a printzone above the sheet, with the pen shooting drops of ink as it moves. By selectively energizing the resistors as the printhead moves across the sheet, the ink is expelled in a pattern on the print media to form a desired image (e.g., picture, chart or text). The nozzles are typically arranged in one or more linear arrays which are typically oriented perpendicular to the scanning direction. Thus, the length of the nozzle arrays defines a print swath or band. That is, if all the nozzles of one array were continually fired as the printhead made one complete traverse through the printzone, a band or swath of ink would appear on the sheet. The width of this band is known as the "swath width" of the pen, the maximum pattern of ink which can be laid down in a single pass.

It is apparent that the speed of printing a sheet can be increased if the swath width is increased. That is, a printhead with a wider swath would require fewer passes across the sheet to print the entire image, and fewer passes would increase the throughput of the printing mechanism. "Throughput," also known as the pages-per-minute rating, is often one of major considerations that a purchaser analyzes in deciding which printing mechanism to buy. While it may seem to the inexperienced an easy thing to accomplish, merely lengthening the nozzle array to increase throughput, this has not been the case. For thermal inkjet pens in particular, there are some physical and/or manufacturing constraints to the size of the substrate layer within the printhead. In the past, inkjet printheads have been limited in swath width to around 5.4 mm (millimeters) for tri-chamber color printheads, and around 12.5 mm (about one-half inch) for monochrome printheads, such as black printheads.

Recent breakthroughs in technology have given hope to developing a printhead with a 25 mm swath width (about one inch wide), which is double the width previously obtainable, and fixture developments may bring about even wider swath printheads. Unfortunately, the possibility of a wider swath width brings on other problems which have not previously been encountered, such as how to provide a uniformly level printing surface under the wider printhead. This media support issue is a significant problem in large format inkjet plotters, which feed media (e.g. paper or fabric) from a large roll for printing D-sized or E-sized engineering or architectural drawings, or posters, for instance. The length of the printzone in these plotters is often over a meter (around four feet). The use of inkjet plotters for printing on fabric provides clothing designers and others great new opportunities for creativity because they are no longer are restricted to only the fabric colors and patterns supplied by the textile manufacturers.

In the past, with a 12.5 mm (one-half inch) wide print swath, the media was adequately supported by a roller which ran across the entire length of the printzone. Using a roller with a diameter of about 75 mm (about three inches) supported the media nearly linearly at the one-half inch print swath across the entire printzone. That is, any variation in the media-to-printhead spacing along the length of the nozzle array yielded visually acceptable deviations in print quality using the earlier smaller swath printheads. While a simple answer may be to increase the roller diameter to accommodate the new larger printhead, in a commercially viable plotter, such a larger diameter roller would not be acceptable. A larger diameter roller would not only increase the cost and weight of the plotter, but it would also increase the overall size and weight of the plotter, undesirable side effects in today's compact office environments.

Another significant problem in these large format plotters is advancing the media very accurately from one print swath to the next. One system for moving the media through the plotter printzone is shown in U.S. Pat. No. 5,342,133 ("the '133 patent"), which is assigned to Hewlett-Packard Company, the assignee of the present invention. The plotter of the '133 patent grips the edges of the media to move it through the printzone. While the '133 patent worked well for the earlier inkjet pens having only a 12.5 mm (one-half inch) print swath, it was unable to maintain the uniform printhead to media spacing required for a 25 mm (one inch) wide printhead because the majority of the print swath was unsupported.

In large format plotters, the stiffness of the typical media (paper) is insufficient to enable driving the media along its edges while maintaining good positional accuracy in the middle of the sheet. That is, when the media is only supported along its edges, it tends to sag under its own weight, increasing the printhead-to-media spacing near the middle of the sheet, which can blur the center of the printed image. This deficiency of the '133 patent plotter becomes even more evident when printing an image that requires a large quantity of ink, which causes the media, especially paper or fabric, to become saturated and soggy.

For instance, plotters are typically used to print engineering and architectural drawings, but recent advances in technology make the printing of enlarged photographic images (e.g. posters or T-shirts) on D-sized and E-sized media now possible, both technologically and economically. These posters or T-shirts often carry photographic images that require far more ink than the normal engineering or architectural drawing, so there is a greater tendency for a photographic image to saturate the media with ink, causing an undesirable effect known in the art as "cockle." The term cockle refers to the tendency of media, such as paper, to uncontrollably bend or buckle as the wet ink saturates the fibers of the medium and causes them to expand. This buckling or cockling causes the media to uncontrollably bend either downwardly away from the printhead, or upwardly toward the printhead, with either motion undesirably changing the printhead-to-media spacing and leading to poor print quality. Moreover, upward buckling can be extreme enough to cause the media to contact the printhead and possibly clog a nozzle and/or smear ink on the media, damaging the image.

Slow drying of the ink can also lead to ink bleeding problems, where the borders between regions of different colors become blurred as the wet inks mix together on the media. In inkjet printers, the problem of drying ink has been attacked by blowing warm air over the printzone to speed drying, for instance, as shown in U.S. Pat. Nos. 5,296,873 and 5,406,316 assigned to the assignee, the Hewlett-Packard Company. Thus, in addition to supporting the media under these large printzones, a system for speeding ink drying is also needed to avoid these ink saturation problems.

Thus, whole new markets are now open for plotters having a high print quality and a high throughput, so that high quality poster-sized images and fabric designs may be rapidly printed, as well as the conventional engineering and architectural drawings.

SUMMARY OF THE INVENTION

One aspect of the present invention addresses the printhead-to-media spacing problem by providing a media support system for an inkjet printing mechanism. Such a printing mechanism typically has a chassis with an inkjet printhead mounted thereto for reciprocal movement along a scanning axis across a printzone. The media support system includes an endless belt having an interior surface and an exterior surface. A transport system has a drive member-that engages the belt and a drive motor that selectively drives the drive member. The support system also has at least one support member, parallel to the scanning axis, that engages the interior surface of the belt adjacent the printzone to define a support zone along a portion of the belt exterior surface to support media thereon in a print plane under the length of the nozzle array across the printzone.

Another aspect of the present invention addresses the ink saturation problem by warming the media support system described above to speed drying of the ink on the media, particularly when printing photographic images or patterns requiring large volumes of ink. In the illustrated ink drying systems, heat may be applied to the media support belt through conductive, inductive, or radiation techniques, each of which serves to warm the media traveling through the printzone. The ink dries faster on the warmed media to speed throughput (sheets per minute printed), avoiding cockle difficulties and ink bleed problems.

In one illustrated embodiment, the support member comprises a shoe member that has a support surface of a low friction material over which the interior surface of the belt slides, with the shoe support surface being parallel to the belt support zone. The system may include an optional printhead-to-media spacing adjustment system that couples the shoe member to the printing mechanism chassis to selectively move the belt support zone toward or away from the printhead. In another illustrated embodiment, the media support system may include a second support member that is parallel to, and spaced apart from, the at least one support member to suspend the belt therebetween to define the support zone.

In yet another illustrated embodiment, the endless belt is a unitary belt extending across the printzone. In another embodiment, the support system further includes plural endless belts spaced apart from one another across the printzone. In another variation, the exterior surface of the endless belt has one or more ribs projecting upwardly therefrom and extending longitudinally in a direction perpendicular to the scanning axis. In still a further embodiment, the endless belt comprises a foraminous belt and the media support system may have a vacuum system having a vacuum source and an inlet plenum. The inlet plenum extends along the interior surface of the foraminous belt adjacent the printzone to pull media in the printzone into engagement with the support zone of the belt.

According to a further aspect of the invention, an inkjet printing mechanism is provided as including the media support system described above.

According to still another aspect of the invention, a method is provided for supporting media for printing in a printzone of an inkjet printing mechanism. The method includes the step of reciprocally moving an inkjet printhead along a scanning axis across the printzone, with the printhead having a nozzle array that is perpendicular to the scanning axis. In a driving step, an endless belt having an interior surface and an exterior surface is driven through the printzone. In a feeding step, media is fed through the printzone on a belt support zone defined by a portion of the belt exterior surface. In a supporting step, the belt interior surface opposite the support zone is supported with at least one support member that is parallel to the scanning axis so the support zone positions the media thereon in a print plane under the length of the nozzle array as the printhead moves reciprocally across the printzone during said moving step. A method is also provided for warming the media to reduce ink drying time, including the steps of applying heat to the endless belt and warming the media with the belt in the printzone.

An overall goal of the present invention is to provide an inkjet printing mechanism which reliably produces clear crisp images while accurately advancing a sheet through a printzone during printing, including printing of posters, fabric designs, and other images having a high ink content.

A further goal of the present invention is to provide a system and method of supporting a sheet of media uniformly under a wide swath inkjet printhead, such as one having a swath width on the order of at least 20 mm to 25 mm.

BRIEF DESCRIPTION OF THE DRAWINGS

FIG. 12 is an enlarged, partially schematic, front elevational sectional view taken along lines 12—12 of FIG. 11.

FIG. 13 is a partially schematic, enlarged side elevational view of the media support and drive system of FIG. 4, here shown including a third embodiment of the ink drying system of the present invention.

DETAILED DESCRIPTION OF THE PREFERRED EMBODIMENTS

Figure 1:
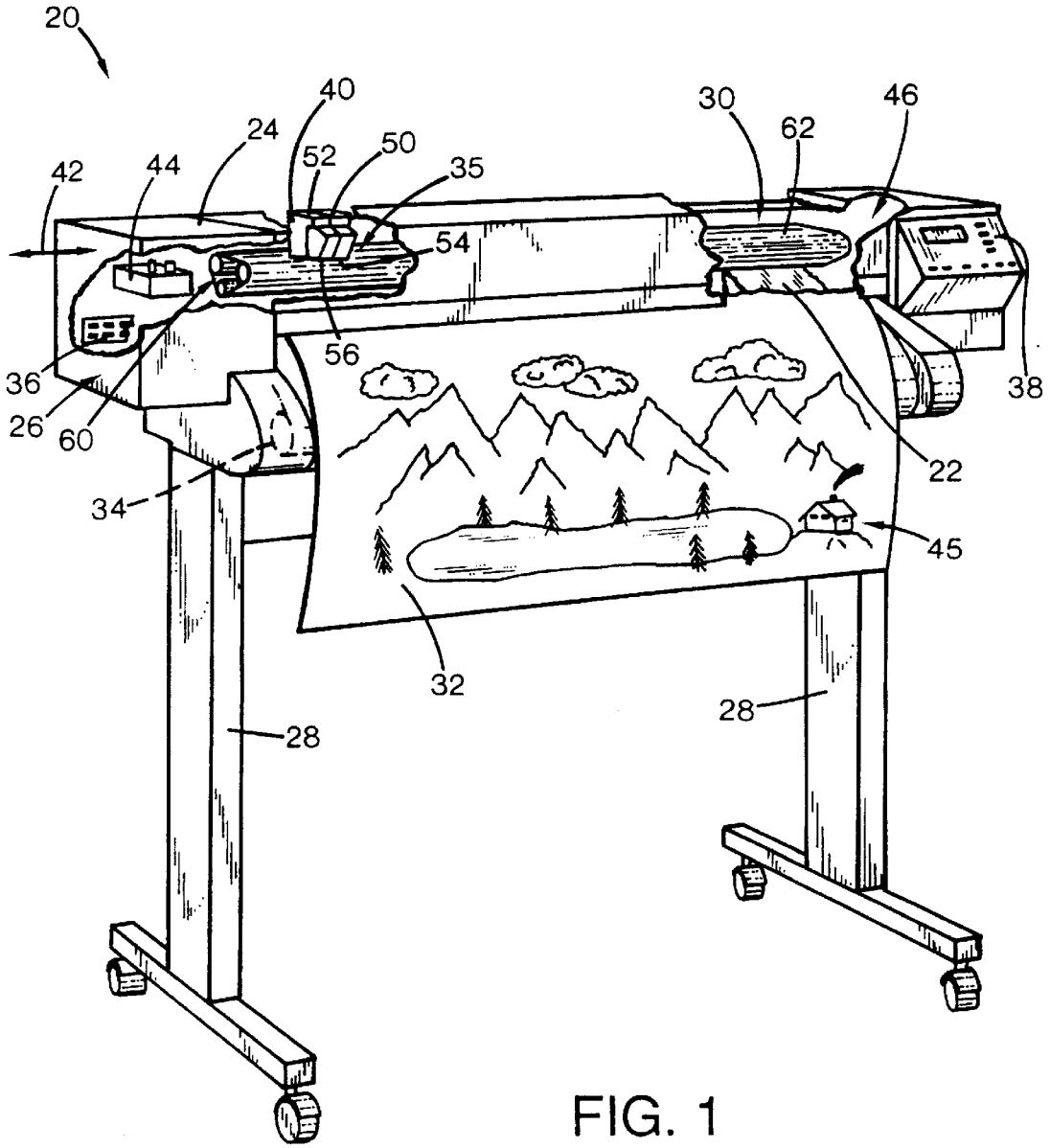
FIG. 1 is a perspective view of one form of an inkjet printing mechanism, here an inkjet plotter, employing one form of a large inkjet print swath media support system of the present invention for maintaining a uniform spacing between print media and an inkjet printhead having a large print swath, for instance about 25 mm (one inch) wide.

FIG. 1 illustrates an embodiment of an inkjet printing mechanism, here shown as an inkjet plotter 20, constructed in accordance with the present invention, which may be used for printing conventional engineering and architectural drawings, as well as high quality poster-sized images, and the like, in an industrial, office, home or other environment. A variety of inkjet printing mechanisms are commercially available. For instance, some of the printing mechanisms that may embody the present invention include desk top printers, portable printing units, copiers, cameras, video printers, and facsimile machines, to name a few. For convenience the concepts of the present invention are illustrated in the environment of an inkjet plotter 20.

While it is apparent that the plotter components may vary from model to model, the typical inkjet plotter 20 includes a chassis 22 surrounded by a housing or casing enclosure 24, typically of a plastic material or sheetmetal, together forming a print assembly portion 26 of the plotter 20. While it is apparent that the print assembly portion 26 may be supported by a desk or tabletop, it is preferred to support the print assembly portion 26 with a pair of leg assemblies 28. A print media handling system 30, described in further detail below, feeds a continuous sheet of print media 32 supplied typically on a roller 34 through a printzone 35. The print media may be any type of suitable sheet material, such as paper, poster board, fabric, transparencies, mylar, and the like, but for convenience, the illustrated embodiment is described using paper as the print medium.

The plotter 20 also has a plotter controller, illustrated schematically as a microprocessor 36, that receives instructions from a host device, typically a computer, such as a personal computer or a computer aided drafting (CAD) computer system (not shown). The plotter controller 36 may also operate in response to user inputs provided through a key pad and status display portion 38, located on the exterior of the casing 24. A monitor coupled to the computer host may also be used to display visual information to an operator, such as the plotter status or a particular program being run on the host computer. Personal and drafting computers, their input devices, such as a keyboard and/or a mouse device, and monitors are all well known to those skilled in the art.

A carriage guide rod mounted to the chassis 22 slideably supports an inkjet carriage 40 for travel back and forth, reciprocally, by a carriage drive motor across the printzone 35 along a scanning axis 42. The carriage drive motor operates in response to a control signal received from the controller 36. One suitable type of carriage support system is shown in U.S. Pat. No. 5,342,133, assigned to Hewlett-Packard Company, the assignee of the present invention. The carriage 40 is also propelled along the guide rod into a servicing region housing a service station 44, located within the interior of casing 24. The service station 44 may be any type of servicing device, sized to service the particular printing cartridges used in a particular implementation. Service stations, such as those used in commercially available plotters and printers, typically include wiping, capping and priming devices, as well as a spittoon portion, as described above in the background portion. Suitable preferred service stations are commercially available in DeskJet® color inkjet printers, as well as in DesignJet® color plotters, all produced by Hewlett-Packard Company, of Palo Alto, Calif., the present assignee.

The pen carriage 40 is advanced across the printzone 35 by the carriage drive motor in response to control signals received from the plotter controller 36. To provide carriage positional feedback information to controller 36, a metallic encoder strip may extend along the length of the printzone 35 and over the service station 44. A conventional optical encoder reader may be mounted on the back surface of printhead carriage 40 to read positional information provided by the encoder strip, for example, as described in U.S. Pat. No. 5,276,970, also assigned to Hewlett-Packard Company, the assignee of the present invention. The manner of providing positional feedback information via the encoder strip reader, may also be accomplished in a variety of ways known to those skilled in the art. Indeed, the carriage 40 may even be positioned using an open-loop control strategy with no feedback at all, such as by using a stepper motor to move the carriage and keeping track of the motor steps.

Upon completion of printing an image 45, such as the landscape scene illustrated in FIG. 1, the carriage 40 latches onto a cutting mechanism portion of the media handling system 30, such as a cutter which is normally housed at a home position within the casing 24 behind the region of keypad 38 as indicated by generally by item 46. The carriage 40 then drags the cutter across the final trailing portion of the media, here past the top of image 45, to sever the portion of the media sheet with image 45 from the remainder of the roll 34. After cutting, the carriage 40 then returns the cutter to its home position at 46. Suitable preferred cutter mechanisms are commercially available in DesignJet® 650C and 750C color plotters, produced by Hewlett-Packard Company, of Palo Alto, Calif., the present assignee. Of course, sheet severing may be accomplished in a variety of other ways known to those skilled in the art. Moreover, the illustrated inkjet printing mechanism may also be used for printing images on pre-cut sheets, rather than on media supplied in a roll 34.

In the printzone 35, the media sheet 32 receives ink from an inkjet cartridge, such as a monochrome black ink cartridge 50 and/or a color ink cartridge 52. The cartridges 50 and 52 are also often called "pens" by those in the art. The illustrated color pen 52 is a tri-compartment, tri-color pen having three reservoirs that carry cyan, yellow and magenta color inks, whereas the monochrome black pen 50 has a single reservoir carrying black ink. In some embodiments, a set of discrete monochrome pens may be used, for instance, black, cyan, yellow and magenta pens, such as supplied in the DesignJet® 650C and 750C color plotters, produced by Hewlett-Packard Company, the present assignee. An "off-axis" system, having main stationary reservoirs for each ink (black, cyan, magenta, yellow) with a tube supply to their respective printheads, may be substituted for the replaceable cartridges 50, 52, so only a semi-permanent printhead assembly and a small ink supply would be propelled by a carriage across the printzone 35. In an off-axis system, the semi-permanent printhead is replenished by ink conveyed through flexible tubing from a stationary main reservoir, which is located "off-axis" from the path of printhead travel. As used herein, the term "pen" or "cartridge" also refers to such an off-axis system, as well as the illustrated replaceable printhead cartridges 50, 52.

The illustrated pens 50, 52 have printheads 54, 56 respectively, for selectively ejecting the ink. While the color pen 52 may contain a pigment based ink, for the purposes of illustration, pen 52 is described as containing three dye based ink colors. The black ink pen 50 is illustrated herein as containing a pigment based ink. It is apparent that other types of inks may also be used in pens 50, 52, such as paraffin based inks, as well as hybrid or composite inks having both dye and pigment characteristics.

Each printhead 54, 56 has an orifice plate with a plurality of nozzles formed therethrough in a pair of parallel, side-by-side linear arrays. Here, the monochrome black pen 50 has a large swath printhead, illustrated as having a pair of linear nozzle arrays each with a length of about 25 mm (about one inch) or greater, as mentioned in the Background portion above. It is apparent that the media support systems illustrated herein may also be used with printheads having shorter or longer nozzle arrays, such as one on the order of about 21 mm (⅝ of an inch). As noted above, the carriage 40 may be modified to carry the black pen 50 and three or more discrete monochrome color pens, which may each also have large swath printheads.

The illustrated printheads 54, 56 are thermal inkjet printheads, although other types of printheads may be used, such as piezoelectric printheads. The printheads 54, 56 include a substrate layer having a plurality of resistors which are associated with the nozzles. Upon energizing a selected resistor, a bubble of gas is formed to eject a droplet of ink from an associated nozzle and onto sheet 32 in the printzone 35. Ink may also be ejected into a spittoon portion of the service station 44 during servicing, or to clear plugged nozzles. The printhead resistors are selectively energized in response to firing command control signals delivered by a multi-conductor strip from the controller 36 to the printhead carriage 40.

Figure 2:
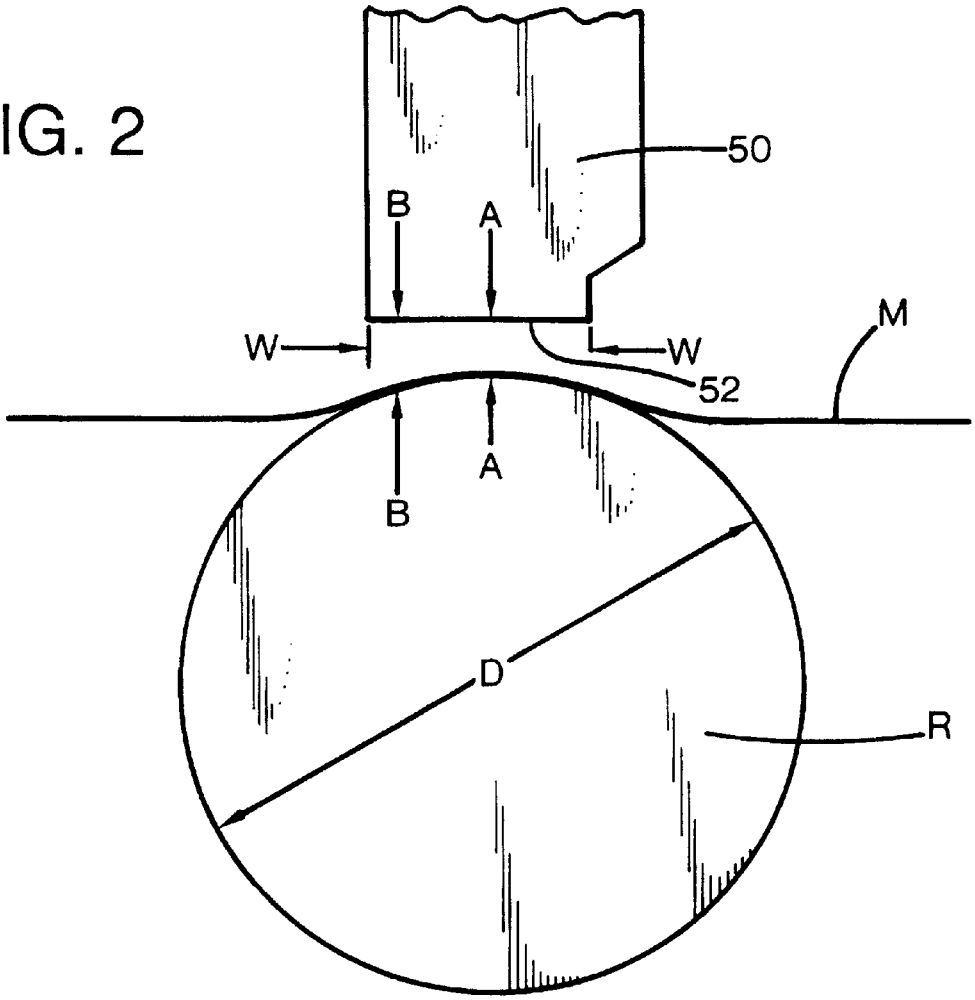
FIG. 2 is an enlarged side elevational view of an attempt to employ a prior art media support system with the new wide swath printhead of FIG. 1.

Before describing a preferred embodiment of the media handling system 30 constructed in accordance with the present invention, the inadequacies of the earlier media support system when used with the new larger printhead 50 will be discussed. FIG. 2 shows a side elevational view of an old roller R having a diameter D of about 75 mm (about three inches). The roller R is propelling a sheet of media M under the new wide swath inkjet cartridge 50, which has printhead 52 with the new print larger swath width W of about 25 mm (one inch). The media-to-printhead spacing is not uniform under the nozzle array, as shown by the different spacings between arrows B and that between arrows A. The A arrows are located near the middle of the nozzle array and have a closer spacing than the spacing between the arrows B, which are located at the end of the nozzle array. The curvature of the roller R causes the flight distance of the ink expelled from the nozzles at each end of the array (arrows B) to be greater than that near the middle (arrows A). This variation in flight distance yields visually detectable and unacceptable print defects. While a simple answer may be to increase the roller diameter, in a commercially viable plotter, such a larger diameter roller would not be acceptable. Indeed, to double the swath width from about 12 mm to 25 mm (from about one half inch to one full inch), while maintaining the same difference in spacing between arrows A and arrows B, requires a 300 mm (about twelve inches) diameter roller, which is four times as large as the current roller. Such a larger diameter roller would not only increase the cost and weight of the plotter, but it would also increase the overall size of the plotter, an undesirable side effect in today's compact office environments.

Large Inkjet Print Swath
Media Support Systems

Figure 3:
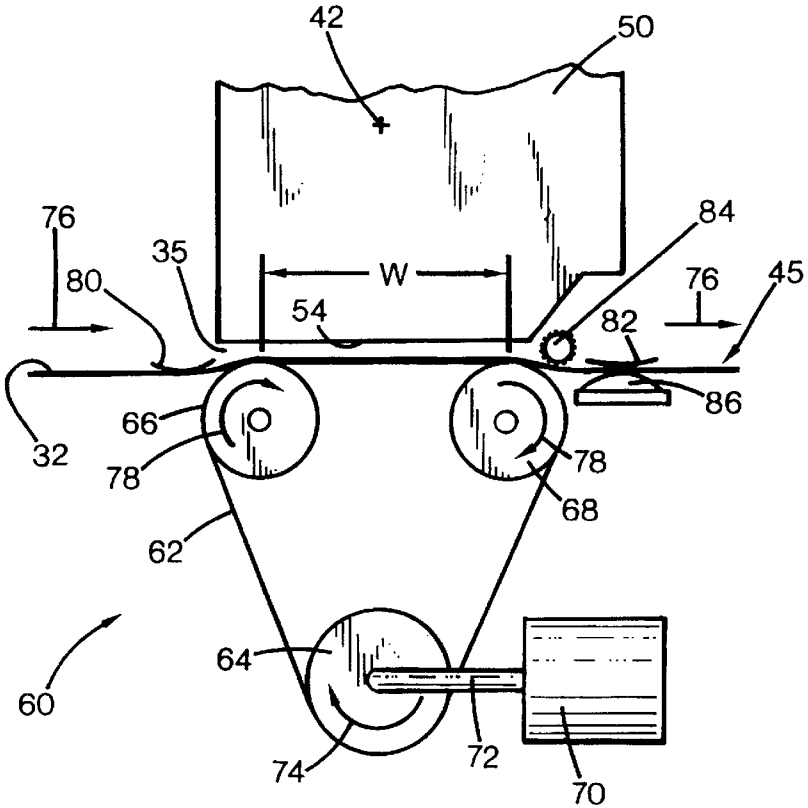
FIG. 3 is an enlarged side elevational view of the media support and drive system of FIG. 1.

FIG. 3 shows a first embodiment of the media handling system 30 as including a large inkjet print swath media support and transport system 60, constructed in accordance with the present invention. The incoming media may be delivered over a series of conventional media guides and/or rollers from the supply roll 34, for example as shown in U.S. Pat. No. 5,342,133 ("the '133 patent"). The '133 patent is described in the Background portion above as including the old roller R shown in FIG. 2 for supporting and transporting the media through the printzone.

The new support system 60 replaces roller R with an endless belt 62 that extends along the length of the printzone 35. The belt 62 is supported by at least two, and preferably three rollers, such as a drive-roller 64, an up-stream support roller 66, and a down-stream support roller 68. Preferably, the rollers 64–68 extend along the length of the printzone 35, engaging an interior surface of belt 62. A media drive motor 70 may be directly coupled by shaft 72, or another coupling mechanism, such as a gear assembly for instance, to drive the roller 64 in the direction indicated by curved arrow 74 to advance the media 32 through the printzone 35. The drive motor 70 may be a stepper motor that operates in response to a control signal received from the plotter controller 36 to move the media in one-swath increments through the printzone, as well as in fractional amounts of a one-swath increment for printing using various multi-pass print modes and the like. The direction of media advance through the printzone 35 is indicated by the straight arrows 76, while the corresponding direction of rotation of the support rollers 66, 68 is indicated by curved arrows 78.

The support rollers 66, 68 suspend the belt 62 at a uniform distance from printhead 54, as well as printhead 56, across the entire length of the nozzle arrays, indicated by dimension W in FIG. 3, which corresponds to the print swath width for pen 50. The media 32 is supported on a support zone along the top of the exterior surface of belt 62 throughout the printzone 35, between rollers 66, 68. Thus, the media 32 is in contact with belt 62 under entire printzone 35, both along the entire swath width and over the entire length of the printzone 35. To keep the media 32 flat against the support zone of belt 62, the rollers 66, 68 may be elevated from the otherwise level travel of media 32, as illustrated in FIG. 3. To further secure the media 32 along the belt support zone, a media retention system may be employed up stream and/or down stream from the printzone 35, such as guide shims 80 and 82, or pinch rollers, for instance elastomeric rollers or star-wheel metallic rollers 84, or other conventional retention systems known it the art.

Advantageously, the drive roller 64 is located below the downstream support roller 68, which allows the belt 62 to drop away quickly from the plane of the printzone 35. This quick exit of the support belt 62 from the post-printzone allows placement of cockle solutions in this region. The term "cockle" refers to the tendency of ink-saturated media to bow and become wavy as it expands due to absorption of the liquid components of the ink between the media fibers. Various cockle solutions have been proposed in the art, such as a series of support ribs 86, for instance, as shown in U.S. Pat. No. 5,393,151, assigned to Hewlett-Packard Company.

Figure 4:
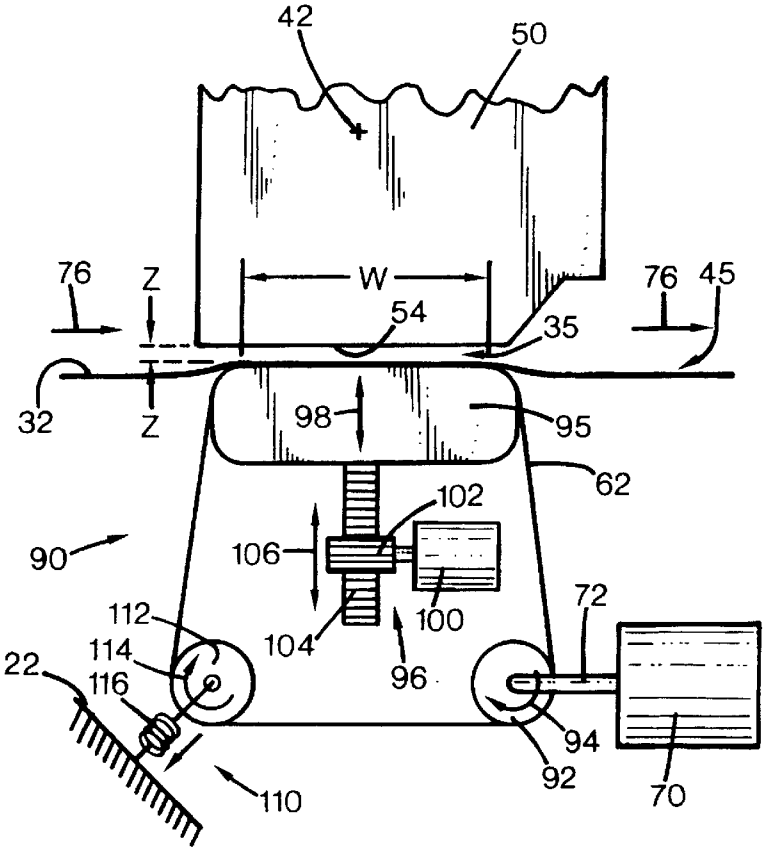
FIG. 4 is an enlarged side elevational view of a second embodiment of a media support and drive system of the present invention.

FIG. 4 shows a second embodiment of a large inkjet print swath media support and transport system 90, constructed in accordance with the present invention, which may be substituted for portions of system 60. Here, the endless belt 62 is driven by drive roller 92, which may be coupled by shaft 72 to motor 70 as described above, to rotate roller 92 as indicated by arrow 94. The support rollers 66, 68 have been replaced with a support shoe 95, which has an upper surface that supports the interior surface of belt 62 in the printzone 35 in a support zone at a uniform drop flight distance Z from the printhead 54. To keep the media 32 flat against the exterior surface of belt 62 in the support zone, the shoe 95 may be elevated from the otherwise level travel of media 32, as illustrated in FIG. 4. It is apparent that the support system 90 may include a media retention system and/or cockle solutions, as described above with respect to item numbers 80–86.

The support system 90 may have an optional printhead-to-media spacing adjustment system, such as mechanism 96, for moving support shoe 95 toward or away from the printhead 54, as indicated by arrows 98, which uniformly changes the drop flight distance Z. In the illustrated embodiment, the spacing adjustment mechanism 96 comprises a rack and pinion gear assembly driven by a motor 100. Here, the motor 100 drives a pinion gear 102, which in turn drives a rack gear 104, as indicated by arrow 106. The rack gear 104 is coupled to the shoe 95 to selectively vary the printhead-to-media spacing across the entire printzone 35. The motor 100 may operate in response to a control signal from the plotter controller 36, or in response to an input received from the keypad 38 to vary the printhead-to-media spacing Z, for example, to increase the distance Z to accommodate thicker media, such as poster board as compared to paper, or to accommodate different media textures, such as mylar or transparencies as compared to paper. It is apparent that other mechanisms may be used to impart the elevational change 98 to shoe 95, such as a manually operated lever system, or other mechanical or electromechanical linkage mechanisms.

When employing the printhead-to-media spacing adjustment system 96, the belt 62 must accommodate the various spacings while maintaining a tensioned condition across the shoe 95 to provide the desired uniform media support throughout the printzone 35. To tension the belt 62 when distance Z is increased by lowering shoe 95, the support system 90 has a tensioning system, such as a belt tensioner 110. The illustrated belt tensioner 110 has a tensioning roller 112 that rotated in direction 114 when the system 90 is feeding media. The roller shaft is coupled by a biasing mechanism, such as tension spring 116, to the chassis 22. When the spacing Z is decreased, the elevating mechanism 96 moves shoe 95 (and media supported thereabove by belt 62) toward the printhead 54, which tensions spring 116. When the spacing Z is increased, spring 116 pulls tensioning roller 112 toward chassis 22 which takes up any resulting slack in belt 62.

Figure 5:
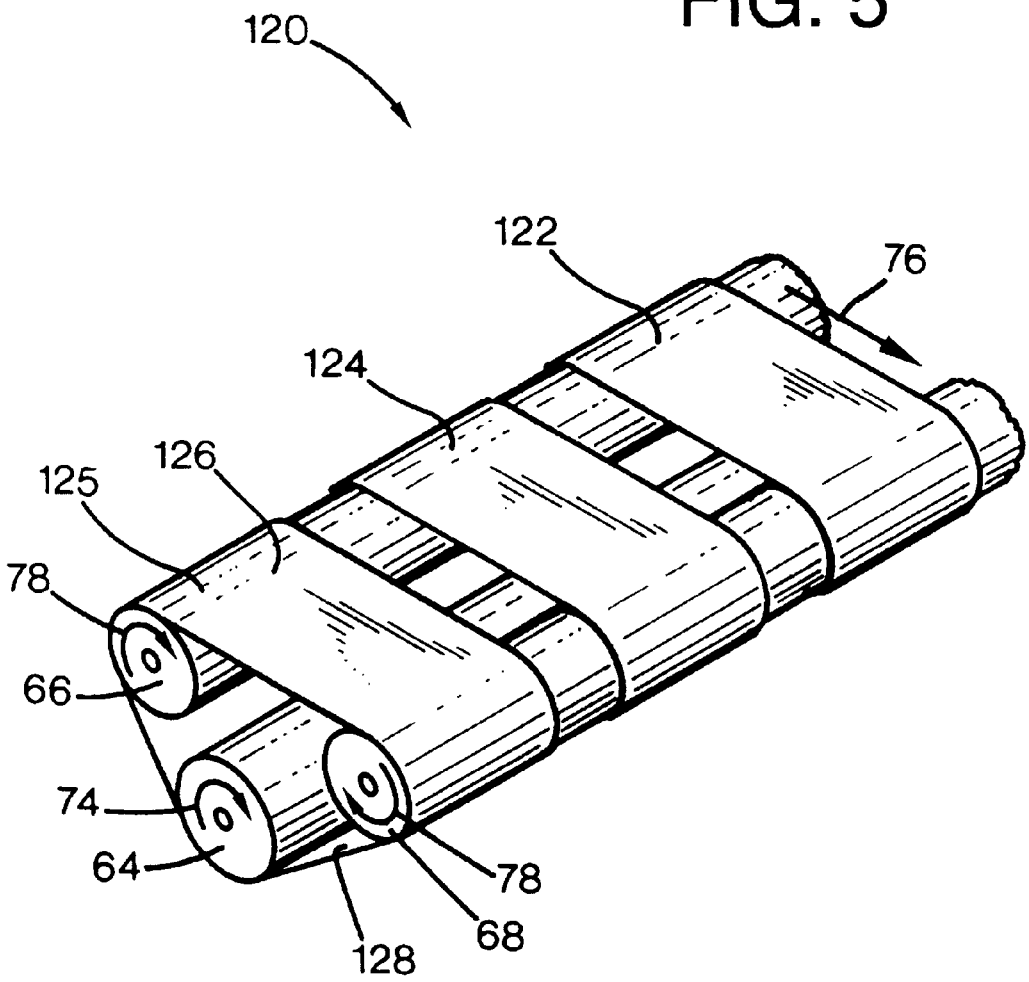
FIG. 5 is an enlarged perspective view of a third embodiment of a media support and drive system of the present invention.

FIG. 5 shows a third embodiment of a large inkjet print swath media support and transport system 120, constructed in accordance with the present invention, which may be substituted for portions of system 60 or 90. Here, the single unitary belt 62 which extends across the entire printzone 30, has been replaced by a series of narrower belts, such as belts 122, 124 and 125. Note that in FIG. 5, only the left portion of the entire drive system 120 is shown for the purposes of illustration. Each of these narrower belts 122, 124, 125 has an exterior surface 126, a portion of which when suspended between rollers 66 and 68 defines a media support zone, as described above for belt 62. Each belt 122, 124, 125 also has an interior surface 128 which is engaged by the drive roller 64. It is apparent that support system 90 of FIG. 4 may be substituted for the illustrated three roller support system when using the plural belt support system 120.

In the illustrated embodiment, where the flat portion of the media support zone is substantially parallel to the printheads 54, 56 which are about 25 mm (one inch) wide, the width of each belt 122, 124, 125 may preferably be about 25 mm (one inch) wide also, with a spacing between adjacent belts being about half the belt width. It is apparent that other sizes, spacings, and numbers of belts may be substituted for those illustrated. The media sheet 32 is suspended between adjacent belts, which may assist in cockle control, by allowing the media to buckle downward in a controlled fashion in the inter-belt spacings.

Figure 6:
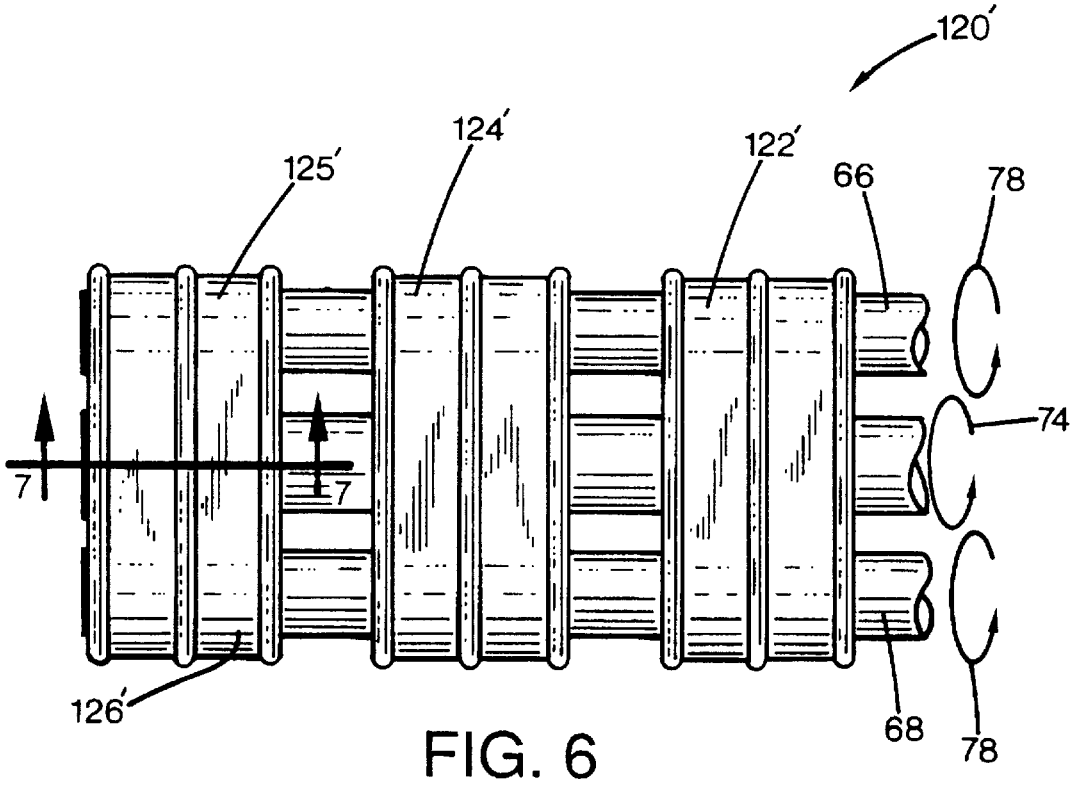
FIG. 6 is an enlarged top plan view of a fourth embodiment of a media support and drive system of the present invention.
Figure 7:
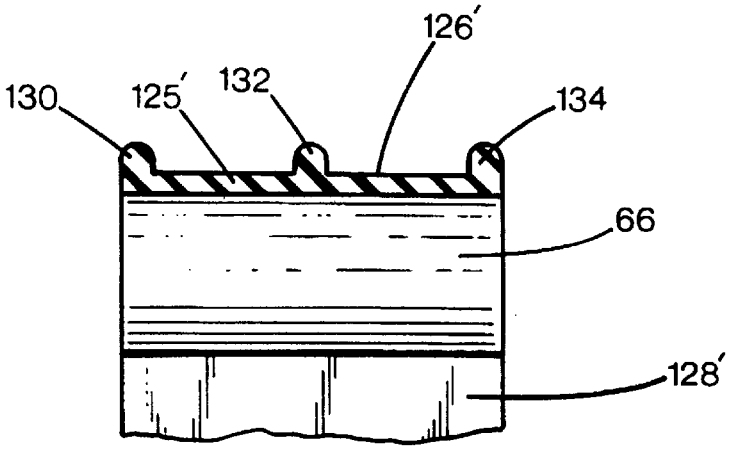
FIG. 7 is an enlarged front sectional view taken along lines 7—7 of FIG. 6.

To better control cockle, the single belt 62 or the plural belt system 120 may employ cockle-control ribs on the exterior surfaces of the belts. For example, FIGS. 6 and 7 show a fourth embodiment of a large inkjet print swath media support and transport system 120', constructed in accordance with the present invention, which may be substituted for portions of system 60 or system 120. Here, the support system 120' is illustrated as having a series of belts, such as belts 122', 124' and 125', each having an exterior and interior surfaces 126' and 128', respectively. The belts 122', 124' and 125' each have at least one cockle control rib, and given the illustrated proportions, preferably three spaced apart ribs 130, 132, 133. During printing, the media sheet 32 is suspended between adjacent ribs, so when saturated with ink, the media may sag down between the adjacent ribs. It is apparent that while the ribs 130–134 are illustrated as bands extending around the belt periphery, they may also be short segments, arranged parallel to one another or otherwise. Indeed, the cockle solution ribs may be of different shapes, and in some implementations, they may be arranged in other patterns, or even randomly.

Figure 8:
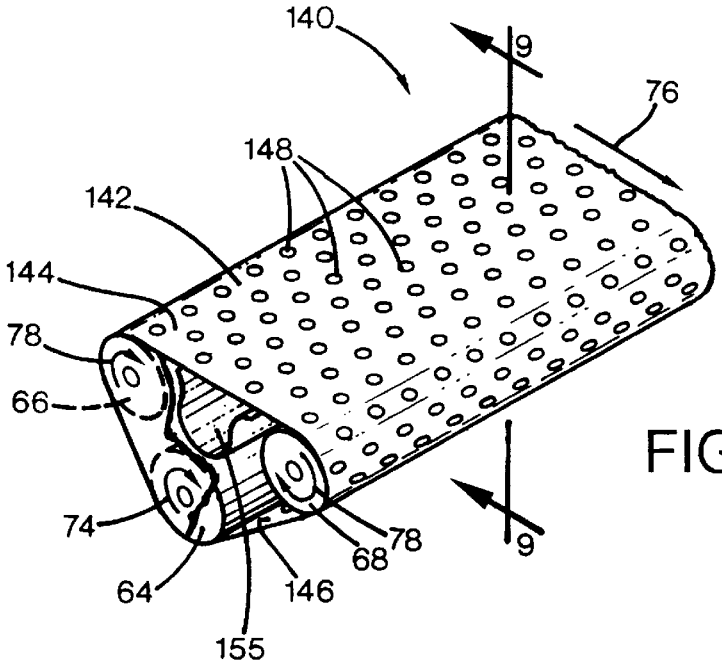
FIG. 8 is an enlarged perspective view of a fifth embodiment of a media support and drive system of the present invention.
Figure 9:
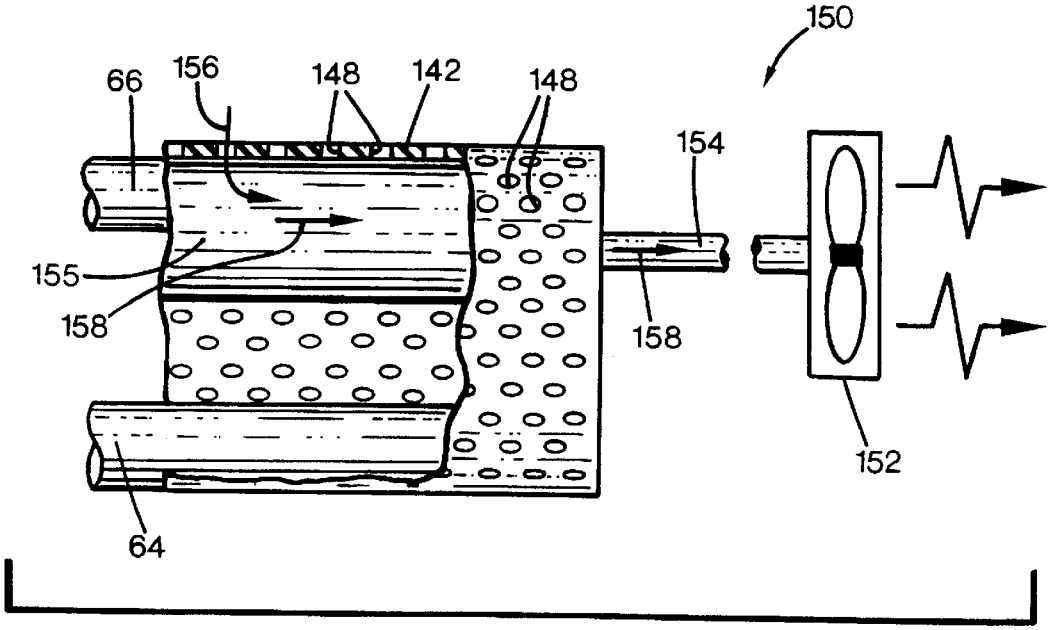
FIG. 9 is an enlarged, partially schematic and partially cut away, front sectional view taken along lines 9—9 of FIG. 8.

FIGS. 8 and 9 show a fifth embodiment of a large inkjet print swath media support and transport system 140, constructed in accordance with the present invention, which may be substituted for portions of system 60, 90, 120, or 120'. Here, the unitary belt 62 of FIGS. 1–4 have been replaced by a unitary foraminous belt 142 having an exterior surface 144 that supports the media in a support zone between support rollers 66 and 68, and an interior surface 146 driven by roller 64. The term "foraminous" refers to the series of openings extending through the belt between the interior and exterior surfaces 146, 144. While these openings through belt 142 may have various shapes and arrangements, the illustrated belt 142 has a group of openings such as slots or holes 148, extending therethrough. It is apparent that the series of belts in FIGS. 5 and 6 may also be foraminous, with openings extending therethrough if desired.

As shown in FIG. 9, one advantage to a foraminous belt 142 is that the media support system 140 may include a vacuum system 150 for creating a region of low pressure under the belt at the support zone to pull the media sheet 32 toward the belt 142. In the illustrated embodiment, a fan unit 152 is used to create the vacuum force. A conduit 154 couples the fan 152 to an inlet plenum 155, located between support rollers 66 and 68 directly under the printzone 30. As the fan 152 operates, air is drawn through holes 148, as indicated by arrow 156, then through plenum 155 and conduit 154, as indicated by arrows 158, and is finally the air is vented to atmosphere after passing through fan 152.

Thus, the foraminous belt support system 140 may be used instead of, or in addition to, the media guides 82, 82 and rollers 84. Furthermore, the vacuum system 150 may also be employed with the plural belt systems 120, 120', whether the plural belts are foraminous or not. That is, spacings between adjacent belts may serve the same purpose as the belt holes 148 to pull the media toward the belt exterior surface. Moreover, it is apparent that the support shoe 95 of FIG. 4 may be substituted for the three roller system shown in FIGS. 8 and 9. In such a system, the shoe 95 may be readily modified to serve as the inlet plenum 155, for example, by placing a series of openings in the upper support surface of shoe 95, under the printzone 30. The modified shoe then may be coupled to fan 152 as described above with respect to FIG. 9.

In operation, a method is provided for supporting media 32 for printing in the printzone 30. The method includes the step of reciprocally moving a large swath inkjet printhead 50, 52 along the scanning axis 42 across the printzone 30, with the printhead having a nozzle array with a length of about at least 25 mm (one inch) that is perpendicular to the scanning axis 42. In a driving step, the endless belt 62, 142, or belts 122–125, 122'–125', are driven through the printzone 30, here by drive roller 64 or 92. In a feeding step, media 32 is fed from roll 34 for instance, through the printzone 30 on a belt support zone defined by a portion of the belt exterior surface. In a supporting step, the belt interior surface opposite the support zone is supported with at least one support member 66, 68 or 95 that is parallel to the scanning axis 42 so the support zone positions the media 32 thereon in a print plane under the length of the nozzle array as the printhead 50, 52 moves reciprocally across the printzone 30 during the moving step.

The method may also include the steps of selectively moving the belt support zone toward or away from the printhead, for instance, using the optional printhead-to-media spacing adjustment system 96. In response to this adjustment, any slack may be removed from the belt 62 using the tensioner 110. The supporting step may be accomplished by supporting the belt 62, 142 or belts 122–125, 122'–125' with two members 66, 68 spaced apart from one another to suspend the belt therebetween to define the support zone along the belt exterior surface. The method may also include the steps of suspending a portion of the media between adjacent ribs in the printzone, for instance when using the ribbed belt system 120', and controlling media expansion caused by ink saturation by allowing the ink-saturated expanding portion of the media to expand between said adjacent ribs. When the driving step is accomplished using the foraminous belt 142, the method further includes the step of pulling the media in the printzone into engagement with the support zone of the belt by creating a low pressure region along the interior surface of the foraminous belt adjacent the printzone, for instance by applying a vacuum force with system 150 along the interior surface 146 of the foraminous belt 142 adjacent the printzone.

Ink Drying Systems

Figure 10:
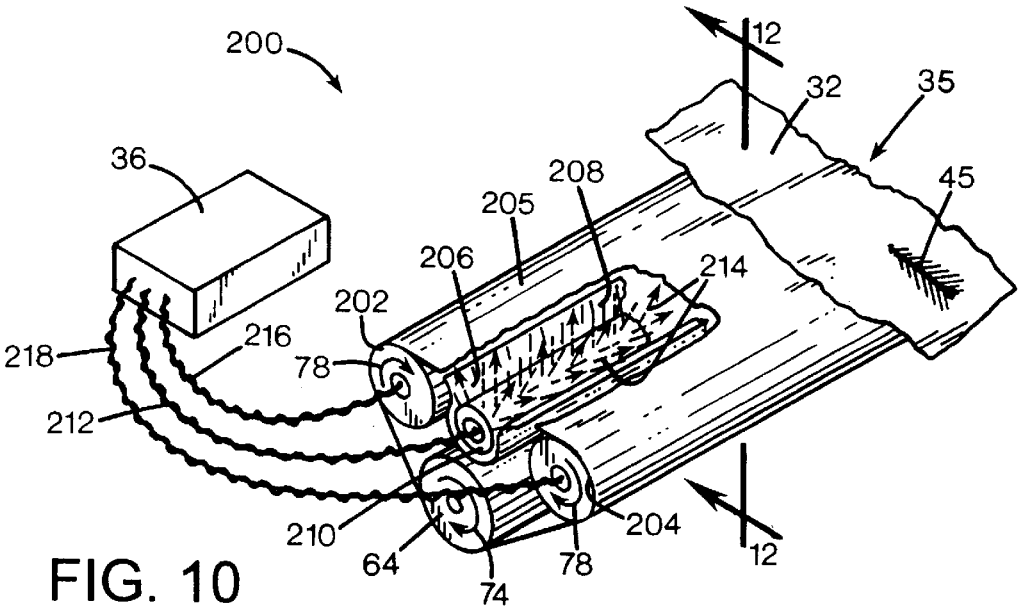
FIG. 10 is an enlarged, partially schematic, perspective view of the media support and drive system of FIG. 1, here showing first and second embodiments of an ink drying system of the present invention.

In FIG. 10, another embodiment of a media support and drive system 200 is shown as including two embodiments of ink drying systems, constructed in accordance with the present invention, which may be used separately or together. As described in the Background section above, when printing images that require a large quantity of ink, such as photographic images or when printing patterns on fabric, it is desirable to dry the ink as soon as possible to alleviate cockle problems, particularly with paper. Quick drying of the printed ink also avoids ink bleed problems which may blur the boundaries between two adjacent regions of different colors. The system 200 has upstream and downstream support rollers 202, 204 which support an endless belt 205 in the region of the printzone 35. The belt 205 may be propelled around support rollers 202, 204 using drive roller 64, described above with respect to FIG. 3, and in the directions indicated by arrows 74 and 78.

In the region occupied by the vacuum inlet plenum 155 of FIGS. 8 and 9, the system 200 instead includes a heat reflecting shield 206, which preferably has a parabolic cross-sectional shape. The shield 206 may be any type of metallic or other material shaped to define a heat chamber 208 along the interior surface of belt 205, opposite the printzone 35. Other locations for the heat chamber 208 and other shapes for the heat shield 206 may be better suited for some implementations. For example, it may be desirable to pre-heat upstream portions of the belt 205 before entering the printzone 35, for instance by locating the heat chamber between the drive roller 64 and the upstream roller 202 instead of, or in addition to, the location shown in FIG. 10.

The system 200 includes a heating element 210 mounted within the interior of the heat chamber 208. The heating element 210 may take on a variety of different configurations, each of which generates heat within chamber 208, which is then reflected by shield 206 upwardly toward the undersurface of the belt 205. The heat is then transferred through the belt 205 to undersurface of the printed sheet of media 32 to assist in drying image 45. The heating element 210 may receive power from the controller 36, via conductor 212. A variety of linear heating elements are available to serve as the heating element 210, such as a cylindrical or tubular light bulb, for instance. Heating rods are also commercially available, such as those for heating small safes and other enclosures to keep documents and other possessions free of moisture.

Thus, whether the heating element 210 merely generates heat, or also generates light, either system serves as a radiant heating source for warming belt 205, which in turn warms the media 32. This radiant heat is illustrated in FIG. 10 by a series of dashed lines and dashed arrows 214, indicating the radiation of heat from the heating element 210 toward the belt 205. Indeed, to assist in heat transfer from the underside of belt 205 to the upper surface which supports the media 32, it may be desirable to construct belt 205 of a flexible metal, such as a stainless steel. Alternatively, it may be desirable to incorporate such metallic elements within the belt 205, for instance by embedding metallic layers, plates or wires within an elastomer, or a fabric type belt. Thus, belt 205 may be a metallic or a semi-metallic composite structure. Furthermore, the belt may be solid as shown, or foraminous with a series of apertures defined therethrough, such as holes 148 for belt 142 shown in FIGS. 8 and 9.

In addition to, or instead of, the heating element 210 and heat shield 206, the system 200 may include heated rollers, such as heated upstream and downstream support rollers 202, 204. The rollers 202 and 204 may each have internal heating elements, which may receive power via conductors 216, 218, respectively, from the printer controller 36. The heating elements internal to the rollers 202, 204 may be as described above for the element 210, with the interior of the rollers 202, 204 being heated, with this heat then transferring to an outer surface of the rollers and then through direct contact to the undersurface of belt 205. Heating with the upstream roller 202 warms the media 32 before receiving ink. The downstream roller 204 applies heat to the media after printing, as well as keeping the belt 205 warm as it travels around the drive roller 64 and back to the entrance of the printzone 35 near roller 202.

Figure 11:
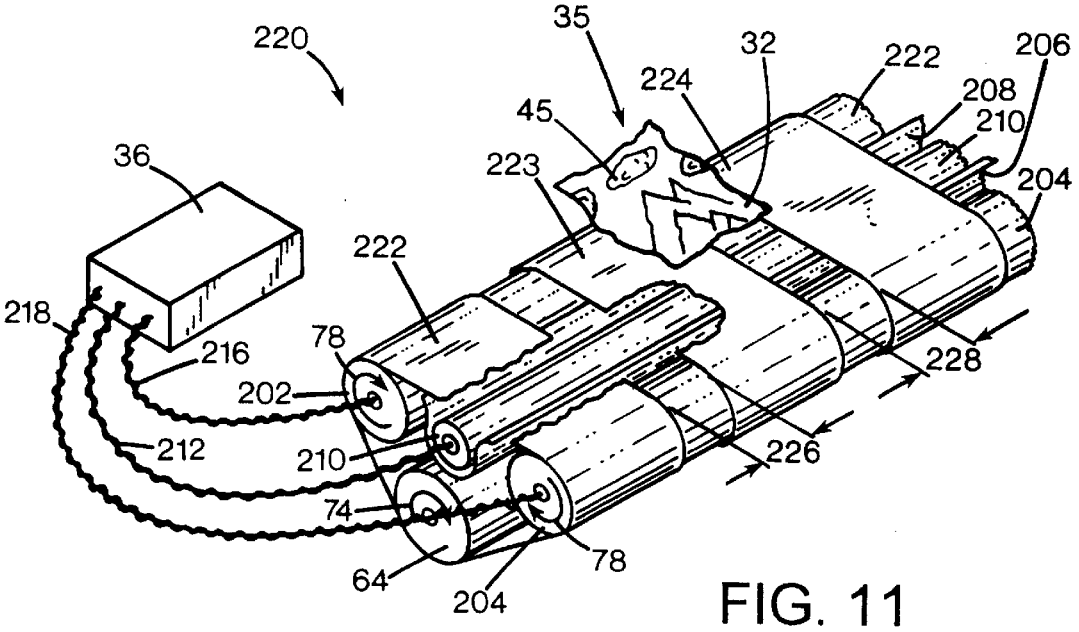
FIG. 11 is a partially schematic, enlarged perspective view of the media support and drive system of FIG. 5, here shown as including the first and second embodiments of the ink drying system of the present invention.

FIG. 11 illustrates a seventh embodiment of a media heating and support system 220 constructed in accordance with the present invention, here, using a segmented belt, having a plurality of belt segments, such as segments 222, 223, 224. Each of the belt segments 222–224 are separated by an interbelt region, such as region 226 which lies between belts 222 and 223, and region 228 which lies between belts 223 and 224 in FIG. 11. The belt segments 222–224 may be constructed as described above with respect to the segment belts 122, 124, 126 of FIG. 5 or, as ribbed belts 122', 124', 126' shown in FIGS. 6 and 7. Furthermore, the belt segments 222–224 may also be constructed of a metallic material, such as stainless steel, or of an elastomer or fabric having metallic segments embedded therein to assist in heat transfer through the belt segments 222–224.

The system 220 may be equipped with upstream and downstream heated rollers 202, 204, which may be heated as described with respect to FIG. 10. The system 220 may also include the heat shield 206 with the heating element 210 as described above with respect to FIG. 10, in addition to, or instead of the heated rollers 202, 204. In the embodiment of FIG. 11, the radiant heat source 210 directly heats a portion of the undersurface of the media 32 between the interbelt regions 226 and 228. When the support rollers 202 and 204 are heated, the heat is radiated directly from the exterior surface of the rollers 202, 204 to the undersurface of the media 32 at the interbelt regions 226, 228.

The segmented belt embodiment 220 (FIG. 11) may be preferred over the single belt system 200 (FIG. 10) as being more efficient because a portion of the heat generated by element 210 or rollers 202, 204 is radiated directly to the undersurface of the media 32 through the interbelt regions 226, 228, eliminating some of the heat that would otherwise be lost during transfer through the belt 205. Furthermore, by applying heat directly through the interbelt regions 226, 228, bands of higher temperature heat may then be applied to the media 32, with these higher temperature heat bands serving to warm additional portions of the media which overlie the edges of the belt segments 222–224.

For system 200 or 220, when both the heating element 210 and the heated rollers 202, 204 are supplied for plotter 20, the controller 36 may selectively heat the media 32 using either the heating element 210, or one or both of the rollers 202, 204. Alternatively, for some print jobs having very little ink saturation, for instance engineering schematic drawings, the controller 36 may use only one of the heating elements 210, 202 or 204, two of the heating elements such as 202 and 210, or none of the heating elements. The use of the heating elements 210, 202 and 204 may also be varied based upon the quality of the draft selected, for instance if presentation quality is required with heavy ink saturation, full heating may be used, whereas if a draft print quality is selected, one, two or none of the heating elements may be employed. Selective energization of the heating elements 210, 202, 204 by the controller 36 advantageously saves energy by eliminating the use of unnecessary heating.

FIG. 12 illustrates one manner of constructing the interior of the heating rollers 202 and 204, which may be particularly useful when different widths of media are routinely printed by plotter 20. In FIG. 12, the support roller 202 is shown as having a multi-stage heating element 230 inserted through the bore of the roller. The heating element 230 has a plurality of different stages, such as a first stage 232, second stage 234 and a third stage 236. Each of these three heating stages 232–236 receives power from a tri-part cable 216, here shown as having three separate conductors 238, 240 and 242 which respectively service the first, second and third heating stages 232, 234 and 236.

The three-stage heating element 230 may be useful when different widths of media 32 are printed upon. For instance, if the media width extends over only a single stage, such as the first stage 232, then only this first stage may be energized, providing a power-saving feature by allowing the controller 36 not to energize the remaining segments 234, 236. To assist in heat transfer directly from each of the stages 232–236 to the adjacent portion of the roller 202, it may be desirable to line the interior roller 202 with several thermal insulators, such as the disc-shaped thermal insulators 244, 246, 248 and 250. In conjunction with the interior of roller 202, thermal insulators 244, 246 define a first stage chamber 252 therebetween, while insulators 246, 248 define a second stage chamber 254, and insulators 248, 250 define a third stage chamber 256. Heat generated by each of the stages 232–236 is transferred to the adjacent portions of the roller 202 which define the boundaries of chambers 252–256, respectively.

For printing some images, it may be desirable to heat only one or two of the stages 232, 234 or 236, even when printing on media which covers the full width of the printzone 35. For instance, when printing draft quality, which typically has a lower ink saturation and a higher throughput, it may be desirable to activate only the central stage 234, or perhaps only the outboard stages 232 and 236. Furthermore, some images requiring a full sheet of media may print only along a portion of the sheet, leaving the remainder blank. Information concerning the location of the printed portion may be supplied to controller 36, which then responds by determining which of the stages 232–236 are activated. For example, when a banner is printed only along the right third of the media 32, in response to this information, the controller 36 powers only third heating element stage 236. This selective activation by controller 36 of some (or none) of the stages 232–236, rather than all of the stages, serves as an energy-saving feature of plotter 20.

It is apparent that the multi-stage heating concepts illustrated by FIG. 12 may be applied to the radiant heating element 210 of FIGS. 10 and 11. For instance, optional thermal insulators, such as insulators 244–250, may be added to the interior of the heat shield 206 to partition the chamber 208 into plural sub-chambers, such as chambers 252–256 in FIG. 12. Such a modification to element 210 allows the controller 36 to selectively activate none, one, several or all of the heating stages. Furthermore, it is apparent that while three heating stages are illustrated, two, four or more stages may be more suitable in some implementations, and the multi-stage ink drying concepts described above may be applied in such situations.

FIG. 13 illustrates another embodiment of a media support and drive system 260 as including a media heating feature, constructed in accordance with the present invention, which also aids in drying the printed ink. Here, the system 260 has basically the same construction as described for the media support system 90 of FIG. 4, and the common elements between FIGS. 4 and 13 share the same item numbers. In system 260, the media support shoe 95 of FIG. 4 has been replaced with a heated media support shoe 262, which has an interior heating chamber 264 with a heating element 265 installed therein. The heating element 265 may receive power from the controller 36 via a conductor 266.

The heating element 265 may be constructed as described above for the heating element 210, or the heating element 265 may be conducted in a series of stages, as illustrated with respect to FIG. 12. While the heating element 265 is shown schematically in FIG. 13, it is apparent that one or more heating elements may be located within chamber 264, such as two parallel heating elements running the entire width of the printzone 35 (from left to right in FIG. 1). In the illustrated embodiment of FIG. 12, heat is transferred from element 265 through the shoe 262 to the interior surface of media support belt 268. The belt 268 may be constructed as described above for the belt 205. To assist in heat transfer, the shoe 262 may be of a metallic material, and may be define a series of aperture 269 therethrough, which allow heat to flow directly from the chamber 264 to the interior surface of belt 268. Indeed, belt 268 may be formed of a segmented belt, as shown above with respect to FIG. 11, or of a foraminous configuration as shown for belt 142 (FIGS. 8 and 9) to supply heat more directly to the undersurface of the media 32.

Figure 14:
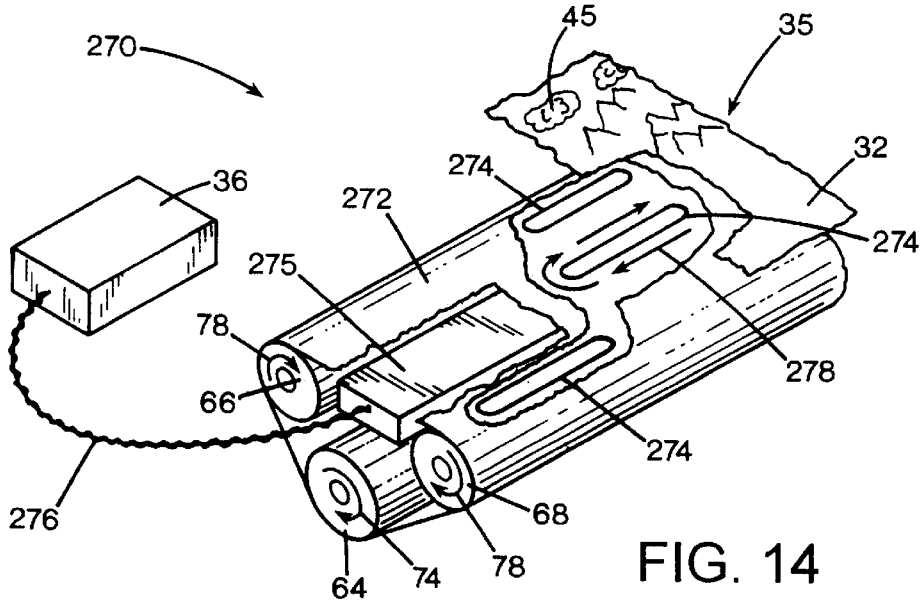
FIG. 14 is an enlarged, partially schematic perspective view of the media support and drive system of FIG. 1, here showing a fourth embodiment of the ink drying system of the present invention.

FIG. 14 illustrates another embodiment of a media support and drive system 270 constructed in accordance with the present invention as including an inductive heating source, rather than the radiant heating sources described above with respect to FIGS. 10–13. The system 270 includes a belt 272 supported by rollers 66, 68 and driven by roller 64, as described above with respect to FIG. 3. The belt 272 has a series of current paths defined therein, such as a plurality of metallic wire loops 274, such as of a copper or other electrical conductor. The system 270 includes a magnetic field generating member, such a magnet 275, which may be either a permanent magnet or an electro-magnet receiving power via conductor 276 from the controller 36. As the belt 272, passes over the region occupied by magnet 275, currents are induced to flow within the conductors 274, as indicated by arrows 278 in FIG. 14. Heat is generated by the current 278, with the generated heat then being applied to the undersurface of the media 32 in printzone 35.

This theory by which currents 278 are induced within the conductors 274, as they are carried by belt 272 through the magnetic field generated by magnet 275, is well-known from the theory of motor and generator operation. Thus, the most cost effective version of magnet 275 may be a permanent magnet that requires no further energy be supplied to power the system 270. Alternatively, it may be desirable to adjust the level of heat induced by currents 278 by controlling the level of current flow 278 within wires 274 with an electromagnetic version of magnet 275, which may be controlled by controller 36. That is, by increasing the amount of energy supplied to the electromagnet 275, the conductors 274 pass through a stronger field to generate larger currents and more heat, for instance to dry heavily saturated images. The controller 36 may selectively apply less energy to electromagnet 275 for a weaker electromagnetic field that induces lower currents which generate less heat, such as when printing in a draft mode, or printing images having lower ink saturation, such as engineering drawings.

Indeed, the possibility exists for an electromagnet 275 to have only certain stages which are energized, so that current flows through only a selected group of the conductor loops 274. In such a multi-stage embodiment, the various multi-stage concepts described above with respect to FIG. 12 may be employed. Furthermore, while the rollers 66 and 68 are shown as being unheated, the concepts described for heated rollers 202, 204 may be used in conjunction with the inductive magnetic heating concepts shown in FIG. 14.

Figure 15:
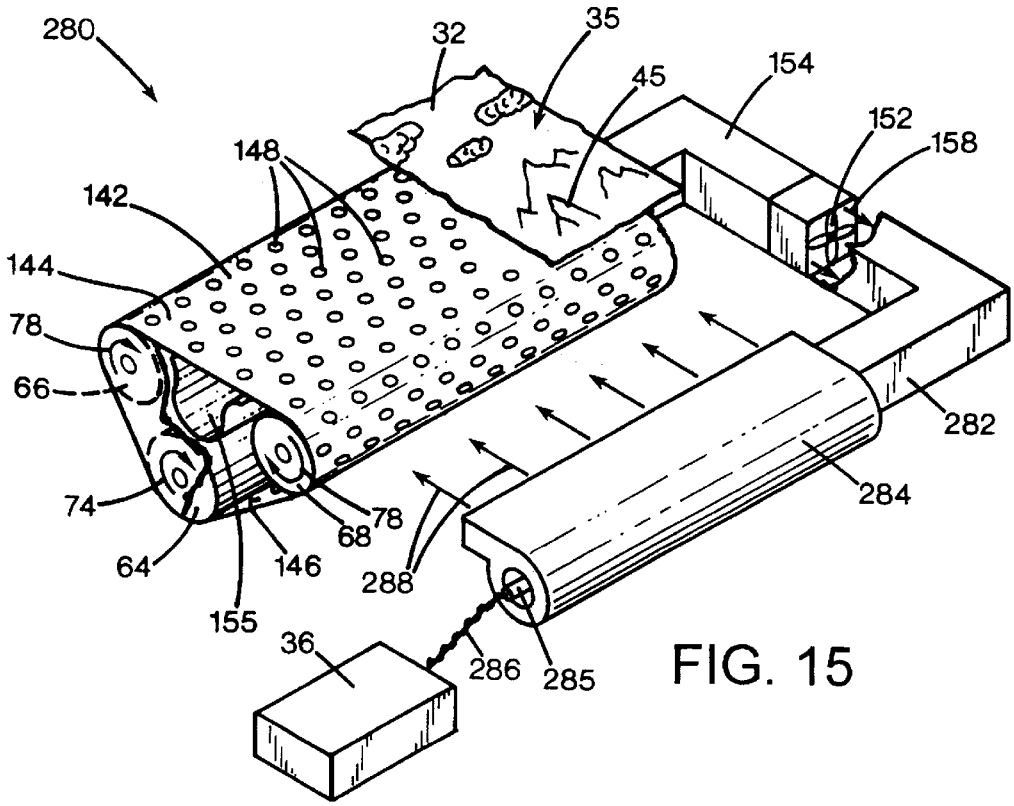
FIG. 15 is a partially schematic, enlarged perspective view of the media support and drive system of FIG. 8, here shown including a fifth embodiment of the ink drying system of the present invention.

FIG. 15 illustrates another embodiment of a media support and drive system 280 constructed in accordance with the present invention as a modification to the foraminous belt system 140 shown in FIGS. 8 and 9. In system 280, the foraminous belt 142 is supported by rollers 66, 68 and driven by roller 64 as described above with respect to FIGS. 8 and 9, as well as FIG. 3. Here, the vacuum airflow 158 is directed from the interior of plenum 155 through conduit 154 by the vacuum fan 152, and then through a conduit 282 into a waste air heater 284. The waste air heater 284 has a heating element 285 installed therein which receives power via conductor 286 from the controller 36. The heating element 285 heats the waste air drawn from the plenum 155. Under the force of fan 152, the heated air 288 exits from the waste air heater 284 through an outlet which is directed toward the printzone 35, with the heated air 288 being shown by a series of arrows in FIG. 15.

Blowing this heated air 288 through the printzone serves to pre-heat the air drawn through the belt holes 148 and into the inlet plenum 155 under the force of the vacuum fan 152. Also, the heated air 228 serves to warm the media, which in turn, warms the belt 142, with this heat then being transferred through the belt 142 and available to contribute to the pre-heating of the vacuum air drawn through the plenum 155. This heat transfer through the belt 142, whether transferred directly through the holes 148 or through the material of the belt itself, contributes to the transfer of heat from the heating element 285 to the media when in the printzone 35 to promote drying of the printed image 45.

The heating element 285 may be any type of a conventional heating element, such as described above for heating elements 210 and 230, or other heating coils may be substituted as known to those skilled in the art. Moreover, while the waste air heater 284 is shown located toward the front or media-injecting side of plotter 20, the outlet of heater 284 may instead be located toward the rear of the plotter 20. Additionally, the system 280 shown in FIG. 15 may be used in conjunction with the heated rollers 202, 204, and/or the magnetic induction heating system 270 of FIG. 14, for instance, by including the metallic conductor loops 274 within the material of the belt 142.

Conclusion

Thus, a variety of advantages are realized by implementing either embodiment of the large print swath media support and transport systems 60 or 90. Both support systems 60, 90 maintain a uniform media-to-printhead spacing throughout the entire printzone. This uniform spacing assures that each ink droplet fired from the printheads 54, 56 travel the same flight distance from the nozzle plate to the media surface, regardless of which nozzle along the length of the array fired the droplet. This equal flight distance provides a higher quality image than obtainable using the earlier roller support system with the larger swath printhead, as discussed with respect to FIG. 2.

Moreover, by supporting the media 32 along the entire printzone, rather than merely along the edges, as proposed in the earlier system, advantageously prevents media sag near the center of the printzone, particularly when printing photographic type images requiring large quantities of ink. Furthermore, the support system 90 illustrates one manner of varying the media-to-printhead spacing Z uniformly across the entire printzone 35. A cockle control solution may also be incorporated into the endless belt drive concept by employing ribs that project upwardly from the exterior surface of the belt to allow ink-saturated media to expand downwardly between adjacent ribs.

A variety of different advantages are also realized by applying heat to the media to aid in drying of the ink, such as the various systems described with respect to FIGS. 10–15. For instance, by speeding drying of the ink, cockle and bleed problems are avoided. By identifying the type or location of the image being printed, the controller 36 may selectively adjust the amount of heat applied to dry the ink, resulting in energy savings which provides a more economical plotter 20 for the consumer.

In describing the operation of systems 200, 220, 260, 270 and 280 above, it is apparent that an ink drying method is also illustrated by these various figures, including the step of applying heat through radiant, conductive, convection, or inductive means to heat the media and dry the ink. The heat may be applied to the media directly in the inter-belt regions 226, 228 as described with respect to the segmented belt of FIG. 11, or through apertures 269 of the support shoe 262 as shown in FIG. 13. Heat may be applied directly to the media through convection, such as by blowing heated waste air 288 across the drying ink image 45 in FIG. 15. Alternatively, the heat may be applied to the media indirectly through the belt itself as described with respect to FIGS. 10 and 13, as well as through the material of the segmented belts 222–224 in FIG. 11. Heating of the belt may also be accomplished through induction using either the electromagnetic or permanent magnet versions of the magnet 275 as shown in FIG. 14.

These ink drying methods may be enhanced through the step of selectively heating only certain regions of the media, either as a power-saving feature, to accommodate different sizes of media 32, or to adjust for the type of image 45 printed. For example, draft print modes, line drawings with minimal ink saturation, or images which cover only a certain portion of the media may require less heat. Variable heat may be applied using the staged heating systems described above, or by applying less power to a single stage heating element, such as element 210 in FIGS. 10 and 11, to the waste heater element 285 of FIG. 15, or to the electromagnetic version of magnet 275 in FIG. 14.

We claim:

1. An inkjet printing mechanism for printing an image on media, comprising:

a chassis;

an inkjet printhead mounted to the chassis to selectively eject ink on the media when in a printzone to form the image;

a media support system including:

(a) an endless belt including plural electrical conductors each forming a current path;

(b) a transport system that engages and drives the belt through the printzone; and (c) a first support roller; and (d) a second support roller which is parallel to and spaced apart from the first support roller to suspend the belt therebetween to define a belt support zone upon which the media is supported in the printzone to receive ink ejected from the printhead; and a heating element located adjacent the belt to transfer heat to the belt support zone and therefrom to the media to dry the ejected ink, wherein the heating element comprises a magnetic member located adjacent the belt support zone to generate a magnetic field through which the belt travels carrying the plural electrical conductors, with travel of the plural electrical conductors through the magnetic field generating an electrical current in each of the plural electrical conductors, with each of said electrical currents generating heat for transfer from the plural electrical conductors to the media at the belt support zone.

2. An inkjet printing mechanism according to claim 1 wherein the magnetic member comprises a permanent magnet.

3. An inkjet printing mechanism according to claim 1 wherein the magnetic member comprises an electromagnet.

4. An inkjet printing mechanism according to claim 3 wherein:

the inkjet printing mechanism further includes a controller that generates a heat control signal in response to the type of image being printed; and the electromagnet adjusts the magnetic field in response to the heat control signal to vary the electrical currents to adjust the heat generated by the plural electrical conductors and supplied to the belt support zone.

5. An inkjet printing mechanism for printing an image on media, comprising:

a chassis;

an inkjet printhead mounted to the chassis to selectively eject ink on the media when in a printzone to form the image;

a media support system including:

(a) an endless foraminous belt having plural apertures extending therethrough;

(b) a transport system that engages and drives the belt through the printzone;

(c) a first support roller; and (d) a second support roller which is parallel to and spaced apart from the first support roller to suspend the foraminous belt therebetween to define a belt support zone upon which the media is supported in the printzone to receive ink ejected from the printhead;

a heating element located adjacent the belt to transfer heat to the belt support zone and therefrom to the media to dry the elected ink;

a vacuum system with a vacuum source and an inlet plenum coupled thereto, with the inlet plenum extending along a surface of the foraminous belt opposite the belt support zone to pull media in the printzone into engagement with the belt support zone, with the vacuum system ejecting waste air from the inlet plenum; and a waste air heater having a heating chamber coupled to receive the waste air ejected from the inlet plenum;

wherein the heating element is located in the heating chamber of the waste air heater to transfer heat from the heating element to the waste air; and wherein the waste air heater has an outlet plenum directed to move the heated waste air over the media when in the belt support zone to transfer heat to the media.

6. A method of drying inkjet ink ejected from an inkjet printhead of an inkjet printing mechanism onto media to print an image, comprising the steps of:

driving an endless belt carrying plural electrical conductors each forming a current path through a printzone of the inkjet printing mechanism;

supporting the belt when in the printzone with a first support roller and a second support roller which is parallel to and spaced apart from first support roller to suspend the belt therebetween to define a belt support zone;

feeding media through the printzone on the belt support zone;

selectively electing inkjet ink from the printhead onto the media when in the printzone to print the image on the media; and drying the ejected ink by generating a magnetic field through which the belt travels during the driving step, generating an electrical current in each of the plural electrical conductors as they are carried by the belt through the magnetic field, and generating heat with each of said electrical currents for transfer to the media at the belt support zone.

7. A method according to claim 6 wherein the drying step comprises the step of generating a magnetic field with a permanent magnet.

8. A method according to claim 6 wherein the drying step comprises the step of generating a magnetic field with an electromagnet.

9. A method according to claim 8 wherein:

the method further includes the step of determining the type of image being printed; and the drying step further comprises the step of adjusting the magnetic field in response to the determining step to vary the electrical currents generated to adjust the heat transferred to the belt support zone.

10. A method of drying inkjet ink ejected from an inkjet printhead of an inkjet printing mechanism onto media to print an image, comprising the steps of:

driving an endless foraminous belt having plural apertures extending therethrough through a printzone of the inkjet printing mechanism;

supporting the belt when in the printzone with a first support roller that defines the heating chamber therein;

supporting the belt with a second support roller parallel to and spaced apart from first support roller to suspend the foraminous belt therebetween to define a belt support zone;

feeding media through the printzone on the belt support zone;

selectively ejecting inkjet ink from the printhead onto the media when in the printzone to print the image on the media;

drying the ejected ink by transferring heat from a heating element to the belt support zone and therefrom to the media;

creating a low pressure region along the interior surface of the foraminous belt adjacent the printzone;

in response to the creating step, pulling the media when in the printzone into engagement with the belt support zone; and generating waste air during the creating step; and wherein the drying step comprises the steps of heating the waste air with the heating element, and moving the heated waste air over the media when in the belt support zone to transfer heat to the media.

* * * * *

UNITED STATES PATENT AND TRADEMARK OFFICE

CERTIFICATE OF CORRECTION

PATENT NO. : 6,168,269 B1
DATED : January 2, 2001
INVENTOR(S) : Rasmussen et al.

It is certified that error appears in the above-identified patent and that said Letters Patent is hereby corrected as shown below:

Column 19,
Line 14, delete "elected" and insert therefor -- ejected --.
Line 45, delete "electing" and insert therefor -- ejecting --.

Signed and Sealed this

Ninth Day of April, 2002

*Attest:*

*Attesting Officer*

JAMES E. ROGAN
*Director of the United States Patent and Trademark Office*